US006389873B1

(12) United States Patent
Garlaschi

(10) Patent No.: US 6,389,873 B1
(45) Date of Patent: May 21, 2002

(54) TOOL-HOLDER FOR MACHINE TOOLS

(76) Inventor: Eufemia Garlaschi, via Victor Hugo, 4-20123 Milan (IT)

( * ) Notice: Subject to any disclaimer, the term of this patent is extended or adjusted under 35 U.S.C. 154(b) by 0 days.

(21) Appl. No.: 09/182,108

(22) Filed: Oct. 29, 1998

(30) Foreign Application Priority Data

Apr. 17, 1998 (IT) ..... MI980279 U

(51) Int. Cl.[7] ..... B21D 37/04
(52) U.S. Cl. ..... 72/481.1; 470/138
(58) Field of Search ..... 470/137, 138, 470/139; 72/481.1

(56) References Cited

U.S. PATENT DOCUMENTS 2,104,297 A * 1/1938 Friedman ..... 470/138
2,305,049 A * 12/1942 Wilcox ..... 470/138
2,595,433 A * 5/1952 Wilcox et al. ..... 470/138
3,101,632 A * 8/1963 Hoyt ..... 470/138
4,170,123 A * 10/1979 Berger ..... 470/138
4,397,172 A * 8/1983 Garlaschi ..... 470/138

* cited by examiner

*Primary Examiner*—David Jones

(57) ABSTRACT

A tool-holder for machine tools, in particular a punch-holder (10) for forging machines utilised for the production of bolts and screws and provided with an oscillating plate (18), is connected to a plate-like support (12) by means of screws (14), and is adjustable on the same by means of eccentrics (16); said plate-like support (12), which bears at least a punch-holder (10), is caused to be interchangeably integral by two or more screws (20) with the oscillating plate (18) of said forging machine.

5 Claims, 1 Drawing Sheet

TOOL-HOLDER FOR MACHINE TOOLS

DESCRIPTION

The present invention relates to a tool-holder for machine-tools. In particular, the present invention relates to a tool-holder particulary usable in forging machines employed for the production of bolts and screws, and suitable to constitute the support for the forging punch or punches.

As is known, in the field of the production of screws, rivets and the like, obtained by cold deformation of wire lengths, special machines are used that carry out sequentially different working operations starting from a semi-finished product, constituted by a wire having a suitable cross-section, which unwinds from a skein.

In the forging machines of the known art, one of the basic problems is associated with the type of product to be obtained in terms of size, or the necessity of systematically replacing the forging members whenever the type of artefact to be made changes. Raw screws or rivets or like small items are in fact obtained on the forging machines by means of special forging tools, in particular by punches caused to be integral with a special support and to co-operate with a matrix restraining the wire that constitutes the semi-finished product.

Therefore, whenever the product to be obtained changes, it is necessary to replace said punches and the related support with others having suitable shape or size, which involves difficult adjustments, with ensuing delays in the time of preparation of the machine.

The object of this invention is to obviate the aforesaid drawback. More particularly, the object of this invention is to provide a tool-holder for machine tools, especially a punch-holder applicable to forging machines employed for the production of bolts and screws, suitable to be easily installed and replaced, with no need for complex adjustments.

A further object of the invention is to provide users with a tool-holder as defined above, such as to ensure a high level of resistance and reliability over time, and also such as to be easily and economically realised.

These and still other objects are achieved by the tool-holder for tool machines of the present invention, in particular a tool-holder for machine tools employed for the production of bolts and screws, provided with an oscillating plate and connected to a plate-like support by means of screws and adjustable on the same by means of eccentrics, characterised in that said plate-like support bearing at least a punch-holder is interchangeably integral on the oscillating plate of the forging machine by means of two or more screws.

The construction and functional characteristics of the tool-holder for machine tools of this invention will be better understood when considered with the following description, wherein reference is made to the attached drawings which represent a non limiting preferred embodiment of the same, and wherein.

Figure 2:
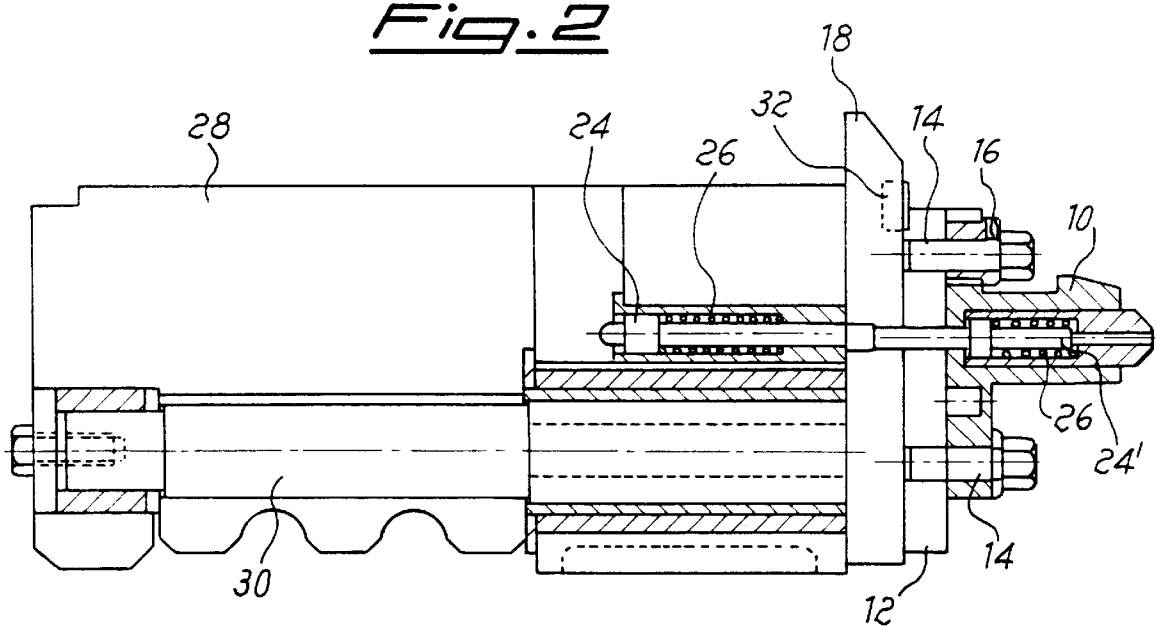
FIG. 2 is a schematic longitudinal section of the same tool-holder.

With reference to the above figures, the tool-holder of this invention, typically a punch-holder for forging machines employed for the production of bolts and screws, is indicated as a whole by 10 and is connected to a plate-like support 12, known in itself, by means of a couple of screws 14' punch-holder 10 is adjustable on support 12 by means of a system of eccentrics 16, also known.

According to the invention, the plate-like support 12 is caused to be integral with the oscillating plate 18, forming part of the forging machine (not shown), by means of two or more screws 20' forms in the upper part a protruding extension 18' adapted to strike, during its oscillatory movement, conventional stop members 22.

Figure 1:
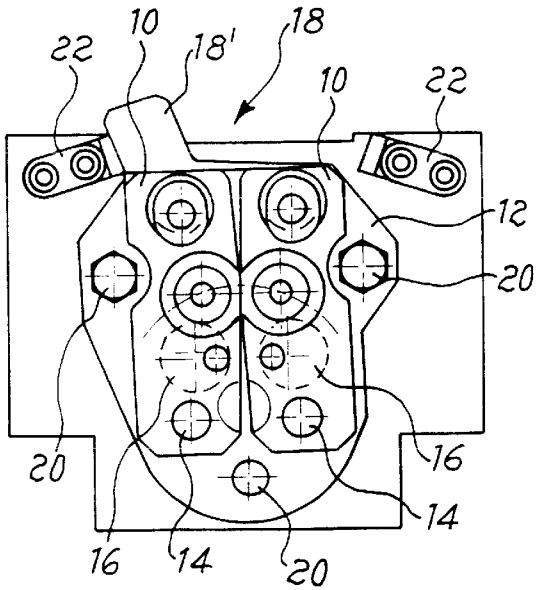
FIG. 1 is a schematic front view of the tool-holder of this invention.

In the preferred embodiment of the figures, as can be especially seen in FIG. 1, two coupled punch-holders 10 are connected to the plate-like support 12, because of the oscillatory movement of plate 18 which leads alternatively either of said punches to operate on the wire to realise the small items, namely screws, rivets and the like. Said wire, which unwinds from a corresponding skein, is fed near the punch-holders 10 by special devices, not included in the invention, comprising extraction pins 24, 24' with the related springs 26 and subjected to working starting from the ram, indicated by 28, of the forging machine, co-operating with a tang 30 integral with the oscillating plate 18. The plate-like support 12 is advantageously coupled to the latter in a precise and unequivocal manner, through reference and strike means 32, constituted by one or more keys or the like.

If the working should be changed, changing therefore also the forging punches, it suffices to replace the plate-like support 12 bearing the punch-holders 10, with another similar support already assembled and provided with suitable seats for housing and restraining differently shaped and/or sized punches, to be used in the case in point. The changing operation is particularly quick and easy for the operator, since it is only necessary to remove plate-like support 12, by loosening and unthreading screws 20 and the installing of another complementary support by the same attachment means. As the replacement of said support 12 does not cause any changes in the operating whole of the forging machine, since it does not affect the working of the same, re-tooling times are markedly reduced, especially considering that the punch or punches are substantially separate or external relative to the operating whole of the machine and therefore the supplementary adjustment or regulation of other devices are not required.

As can be understood from the above, the advantages of the invention are obvious.

The tool-holder of the present invention allows to markedly reduce the machine-tooling time and excludes the need of adjustment operations on the tools or devices whose working is related to the same.

The invention, as described hereabove and claimed hereafter, has been proposed by way of non limiting and non critical example, the same being susceptible of changes and variants, which fall anyhow within the scope of the novel concept.

What is claimed is:

1. A forging machine for producing bolts and screws, said forging machine comprising:

a) an oscillating plate (18);

b) a plate-like support (12) removably mounted on said oscillating plate (18) by means of at least two screws (20); and c) a tool holder (10) connected to said plate-like support (12) by means of a plurality of screws (14) and adjustable thereon by means of eccentrics (16), whereby said plate-like support with said connected tool holder is removably integral with said oscillating plate and is adapted to be removed therefrom and interchanged with another plate-like support with tool holder thereon.

2. The forging machine as defined in claim 1, which further includes at least one obligated strike and centering means (32) for coupling said tool-holder (10) to said oscillating plate (18).

3. The forging machine as defined in claim 2, wherein said strike and centering means (32) are formed on said plate-like support (12) for engagement with said oscillating plate (18).

4. The forging machine as defined in claim 3, wherein said obligated strike and centering means (32) comprises a key.

5. The forging machine as defined in claim 1, wherein said oscillating plate (18) includes an extension (18') protruding with respect to said plate-like support (12) adapted to strike opposing stop members (22) during its oscillating movement.

* * * * *